US006318847B1

(12) United States Patent
Wade

(10) Patent No.: US 6,318,847 B1
(45) Date of Patent: Nov. 20, 2001

(54) SEGMENTED HEATER RESISTOR FOR PRODUCING A VARIABLE INK DROP VOLUME IN AN INKJET DROP GENERATOR

(75) Inventor: John M. Wade, Poway, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/541,349

(22) Filed: Mar. 31, 2000

(51) Int. Cl.[7] ..... B41J 2/05
(52) U.S. Cl. ..... 347/62
(58) Field of Search ..... 347/62, 63, 61

(56) References Cited

U.S. PATENT DOCUMENTS

| | | | |
|---|---|---|---|
| 4,339,762 | 7/1982 | Shirato et al. | 346/140 R |
| 4,458,256 | 7/1984 | Shirato et al. | 346/140 R |
| 4,514,741 | 4/1985 | Meyer | 346/140 R |
| 4,870,433 | 9/1989 | Campbell et al. | 346/140 R |
| 4,935,752 | 6/1990 | Hawkins | 346/140 R |
| 5,142,300 * | 8/1992 | Aoki | 347/183 |
| 5,172,139 * | 12/1992 | Sekiya et al. | 347/15 |
| 5,212,503 | 5/1993 | Saito et al. | 346/140 R |
| 5,455,613 | 10/1995 | Canfield et al. | 347/65 |
| 5,475,405 | 12/1995 | Widder et al. | 347/14 |
| 5,731,828 * | 3/1998 | Ishinaga et al. | 347/62 |
| 5,808,640 | 9/1998 | Bhaskar et al. | 347/58 |
| 5,835,112 | 11/1998 | Whitlock et al. | 347/50 |
| 6,020,905 * | 1/2000 | Cornell et al. | 347/48 |

FOREIGN PATENT DOCUMENTS

| | | | |
|---|---|---|---|
| 0124312 | 4/1984 | (EP) | B41J/3/04 |

* cited by examiner

*Primary Examiner*—John Barlow
*Assistant Examiner*—Michael S. Brooke

(57) ABSTRACT

A segmented heater resistor is provided for producing a variable ink drop volume in an inkjet drop generator. The segmented heater resistor includes multiple heater resistor segments to which a voltage may be selectively applied, resulting in a variable amount of energy dissipated by the segmented heater resistor, a variable amount of heat transferred to ink in the ink drop generator, and a variable ink drop volume expelled by the inkjet drop generator.

14 Claims, 6 Drawing Sheets

SEGMENTED HEATER RESISTOR FOR PRODUCING A VARIABLE INK DROP VOLUME IN AN INKJET DROP GENERATOR

FIELD OF THE INVENTION

The present invention relates to inkjet printing devices, and more particularly to an inkjet printhead drop generator.

BACKGROUND OF THE INVENTION

The art of inkjet printing technology is relatively well developed. Commercial products such as computer printers, graphics plotters, copiers, and facsimile machines employ inkjet technology for producing hard copy printed output. The basics of this technology are disclosed, for example, in various articles in the Hewlett-Packard Journal, Vol. 36, No. 5 (May 1985), Vol. 39, No. 4 (August 1988), Vol. 39, No. 5 (October 1988), Vol. 43, No. 4 (August 1992), Volume 43, No. 6 (December 1992) and Vol. 45, No. 1 (February 1994) editions. Inkjet devices are also described by W. J. Lloyd and H. T. Taub in Output Hardcopy Devices, chapter 13 (Ed. R. C. Durbeck and S. Sherr, Academic Press, San Diego, 1988).

A thermal inkjet printer for inkjet printing typically includes one or more translationally reciprocating print cartridges in which small drops of ink are formed and ejected towards a medium upon which it is desired to place alphanumeric characters, graphics, or images. Such cartridges include a printhead having an orifice member or plate that has a plurality of small nozzles through which the ink drops are ejected. Adjacent to the nozzles are ink firing chambers, in which ink resides prior to ejection through the nozzle. Ink is supplied to the ink-firing chambers through ink channels that are in fluid communication with an ink supply, which may be contained in a reservoir portion of the print cartridge or in a separate ink container spaced apart from the printhead.

Ejection of an ink drop through a nozzle employed in a thermal inkjet printer is accomplished by quickly heating a volume of ink within the adjacent ink firing chamber by applying an energizing electrical pulse to a heater resistor positioned in the ink firing chamber. The electrical pulse induces a temperature rise in the heater resistor, which heat energy is transferred to the ink to produce an ink vapor bubble. The rapid expansion of the ink vapor bubble forces ink through the nozzle. Once ink is ejected, the ink-firing chamber is refilled with ink from the ink channel and ink supply. The energy required to eject a drop of a given volume is referred to as turn on energy. The turn-on energy is a sufficient amount of energy to form a vapor bubble having sufficient size to eject a predetermined amount of ink through the printhead nozzle.

Significant effort has been expended in improving print quality. Since the image output of an inkjet printer is formed of individual ink drops, the image quality and contrasts, as well as variations in image hue and lightness, are dependent on ink drop volume and ink drop distribution on the printed medium. It is known that drop volumes vary with the printhead substrate temperature because the properties that control it vary with temperature: the viscosity of the ink itself and the amount of ink vaporized by a heater resistor when driven by a given electrical printing pulse. One method of controlling drop volume is to vary the electrical pulse width supplied to the heater resistor (see U.S. Pat. No. 5, 726,690). However, inkjet ink is chemically reactive and prolonging of the exposure of the heater resistor and its electrical connections to the ink may result in a chemical attack upon the heater resistor and a deterioration in the long term performance of the heater resistor. Another method of controlling drop volume is to construct a protective layer having a thickness gradient over the heater resistor (see U.S. Pat. No. 4,339,762; see also U.S. patent application Ser. No. 09/302,178, entitled Variable Drop Mass Inkjet Drop Generator, filed Apr., 29, 1999 and assigned to the assignee of the present invention and hereby incorporated by reference herein). However, varying the thickness of the protective layer is subject to the tolerances of the semiconductor manufacturing process and to the tolerances in the heat conduction gradients of the protective materials. Therefore, a need exists for utilizing the printhead substrate temperature in order to intentionally produce ink drops of varying volumes, facilitating additional control and an expanded range of intended variations in hue and lightness of color in images, without the need to vary the electrical pulse width or to vary the thickness of the protective layer.

SUMMARY OF INVENTION

The present invention comprises a segmented heater resistor for an inkjet drop generator by which the amount of thermal energy coupled into the ink can be varied thereby varying the amount of ink ejected according to the amount of heat generated and the amount of resistive surface area exposed. The segmented heater resistor includes multiple heater resistor segments, wherein several of the multiple heater resistor segments are connected in parallel and others of the multiple heater resistor segments are connected in series. Each resistive segment includes multiple connection points, hereinafter referred to as ports. The various resistive segments therefor each include an input port and an output port. Multiple electrical conductors electrically couple the resistive segments together. Each input port and output port of each heater resistor segment is coupled to an electrical conductor of the multiple electrical conductors to which electrical voltages can be applied so as to induce current flow in individual resistor segments. Upon the application of a voltage to one or more of the resistive segments, the associated current flow through the particular segments effects a temperature increase in the resistor segment. The heat generated by the multi-segment resistor is varied by varying the conductors to which the voltage is applied, thereby varying the segments to which voltage is applied. Varying the heat produced by varying the segments that are energized allows for a variable quantity of heat to be generated from the segmented heater resistor to ink that is in thermal contact with the resistive elements. The ink output from the ink drop generator can be controlled by varying the heat that is input to the ink.

DESCRIPTION OF A PREFERRED EMBODIMENT

Figure 1:
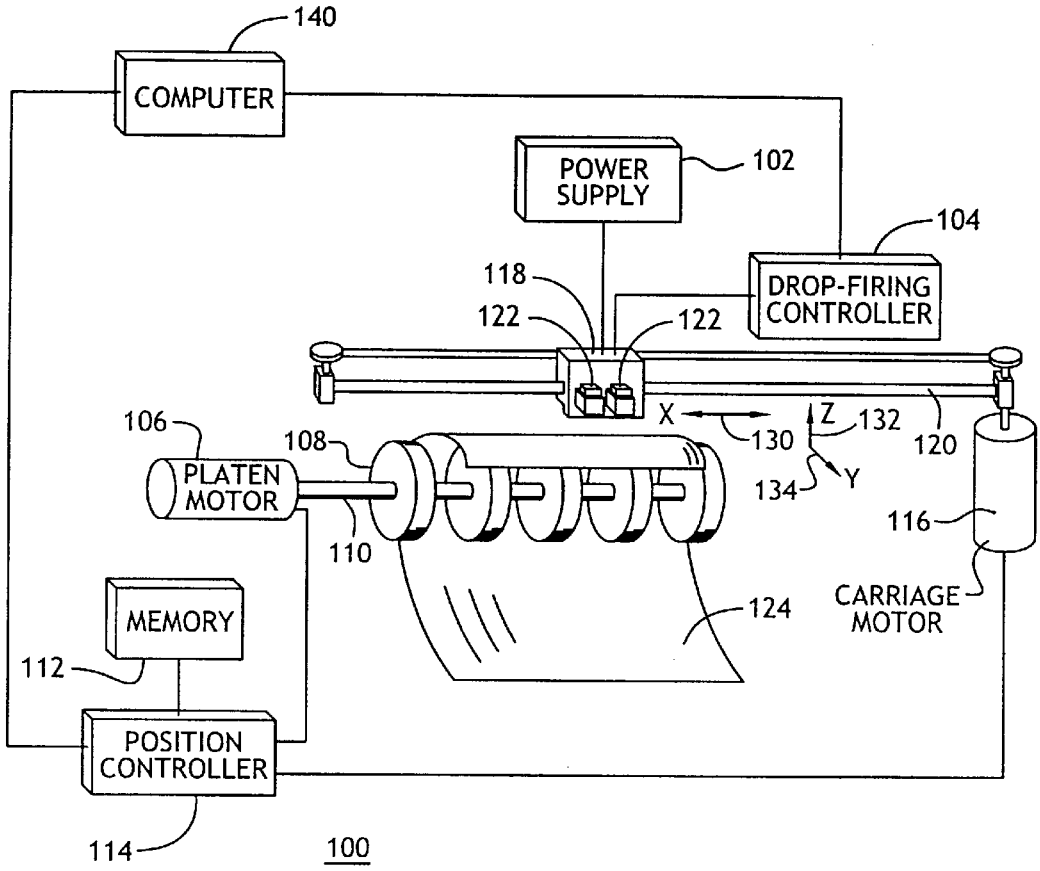
FIG. 1 is a block diagram of an ink jet printer in accordance with a preferred embodiment of the present invention.

FIG. 1 is a block diagram of inkjet printer 100 in accordance with a preferred embodiment of the present invention. Inkjet printer 100 includes a power supply 102, a drop firing controller 104 that includes a processor, preferably a microcontroller or a microprocessor, a platen motor 106, at least one roller 108 coupled to platen motor 106 by a roller bar 110, a memory 112, a position controller 114 coupled to memory 112 and platen motor 106, and a carriage motor 116 coupled to position controller 114, all of which are preferably under the control of a computer 140 that preferably includes a microprocessor. Inkjet printer 100 further includes a carriage 118 coupled to power supply 102 and drop firing controller 104, which carriage 118 includes at least one print cartridge 122. Carriage 118 is mounted on a slide bar 120, allowing carriage 118 to be reciprocated or scanned back and forth across a print media 124, such as paper, by carriage motor 116. The scan axis, X, is indicated by arrow 130. Platen motor 106 and carriage motor 116 are under the control of position controller 114, which controller 114 may be implemented in a conventional hardware configuration and provided operating instructions from memory 112. As carriage 118 scans, ink drops are selectively ejected from each print cartridge 122 onto media 124 in predetermined print swath patterns, forming images or alphanumeric characters using dot matrix manipulation. The ink drop trajectory axis, Z, is indicated by arrow 132. The dot matrix manipulation is determined by computer 140, which computer 140 transmits instructions to drop firing controller 104 and power supply 102. When a swath of print has been completed, media 124 is advanced an appropriate distance along the print media axis, Y, indicated by arrow 134, by platen motor 106 and roller 108 in preparation for the printing of the next swath.

Figure 2:
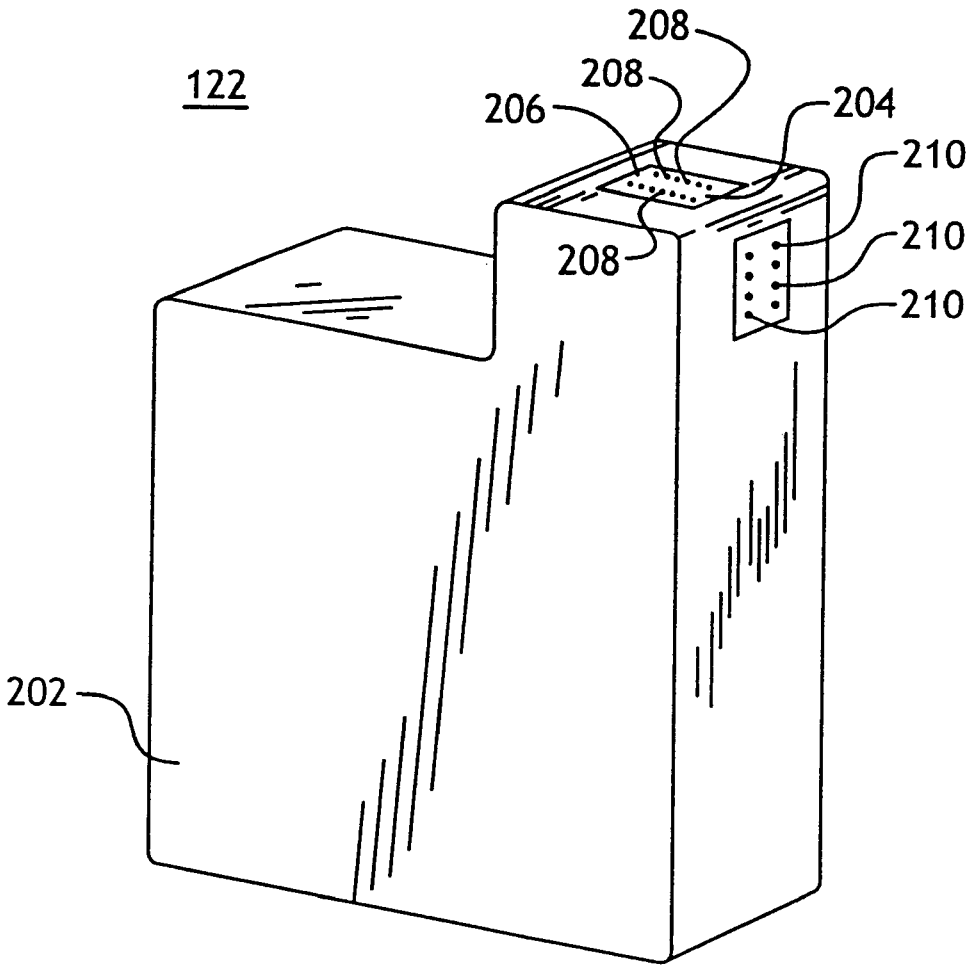
FIG. 2 is an illustration of an inkjet print cartridge of the ink jet printer of FIG. 1 in accordance with a preferred embodiment of the present invention.

FIG. 2 shows a simplified illustration of a thermal inkjet print cartridge 122 in accordance with the preferred embodiment. A cartridge housing, or shell, 202 contains an internal reservoir of ink (not shown); however, in an alternative embodiment, print cartridge 122 includes at least one small volume, on-board, ink chamber that is sporadically replenished from fluidically-coupled, off-axis, ink reservoirs (not shown). Print cartridge 122 is provided with a printhead 204 that includes a foraminous orifice plate 206 having multiple apertures, or nozzles 208, constructed in combination with subjacent firing chambers and structures, and electrical contacts 210 for coupling to printer 100. Each nozzle 208 is a part of an ink drop generator that is found within printhead 204. Typically, multiple nozzles 208 are arranged in a predetermined pattern so that the ink expelled from the nozzles 208 is capable of creating multiple characters or images of print on medium 124.

Figure 3:
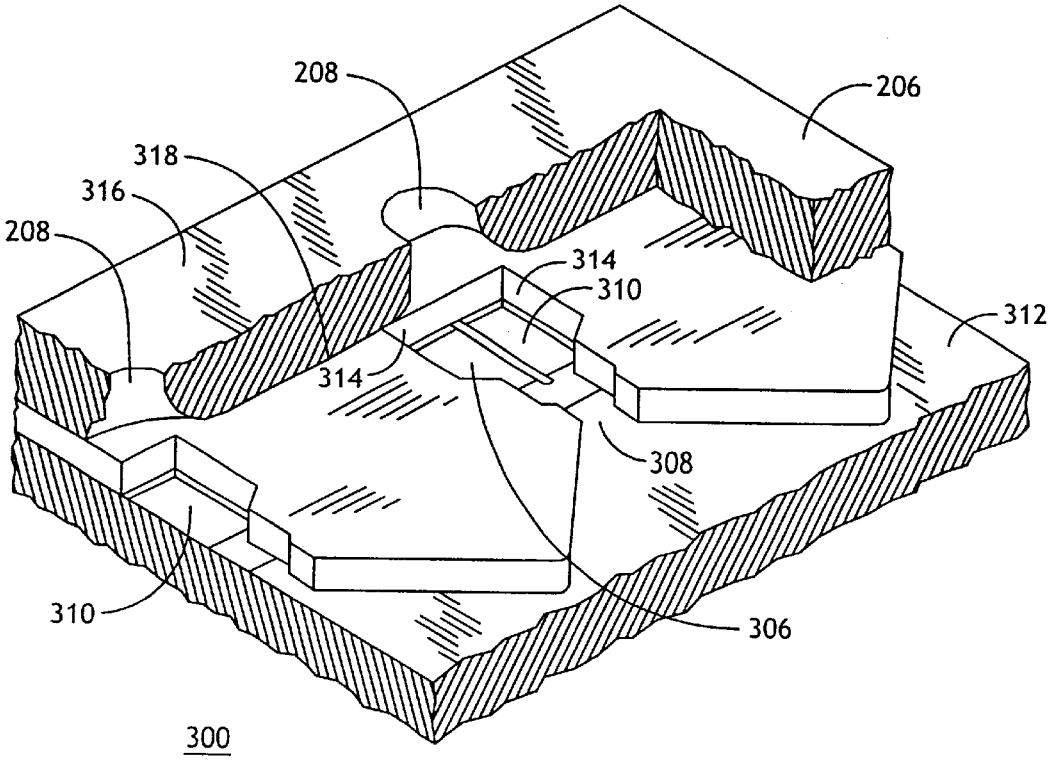
FIG. 3 is a cross-sectional illustration of an ink drop generator of the inkjet print cartridge of FIG. 2 in accordance with a preferred embodiment of the present invention.

FIG. 3 shows a simplified illustration of an ink drop generator 300 in accordance with a preferred embodiment of the present invention. Ink drop generator 300 preferably includes at least a portion of orifice plate 206 and a nozzle 208, and further includes a segmented heater resistor 310. Orifice plate 206 includes a top side 316 and a bottom side 3 18, wherein top side 316 provides an external surface for ink drop generator 300. Generally, medium 124 is maintained in a position that is parallel to the plane of external surface 316 of orifice plate 206. Each segmented heater resistor 310 is selected for activation by drop firing controller 104 and associated circuitry in printer 100 in a pattern related to the data presented to printer 100. When one or more of the resistive segments is appropriately electrically energized, ink is expelled from selected nozzles 208 to define a character or print image on medium 124.

Ink is supplied to ink firing chamber 306 via opening 308 to replenish ink that has been expelled from nozzle 208 following creation of an ink vapor bubble by heat energy released from segmented heater resistor 310. Ink firing chamber 306 is bounded by walls created by orifice plate 206, a layered semiconductor substrate 312, and a barrier layer 314 disposed between substrate 312 and bottom side 318 of orifice plate 206. In the preferred embodiment, a water-based ink is stored in an internal reservoir of cartridge housing 202 and flows by capillary force to fill firing chamber 306. In the alternative, ink fluid may be stored in a reservoir of inkjet printer 100 that is separate from and connected to print cartridge 122.

Figure 4:
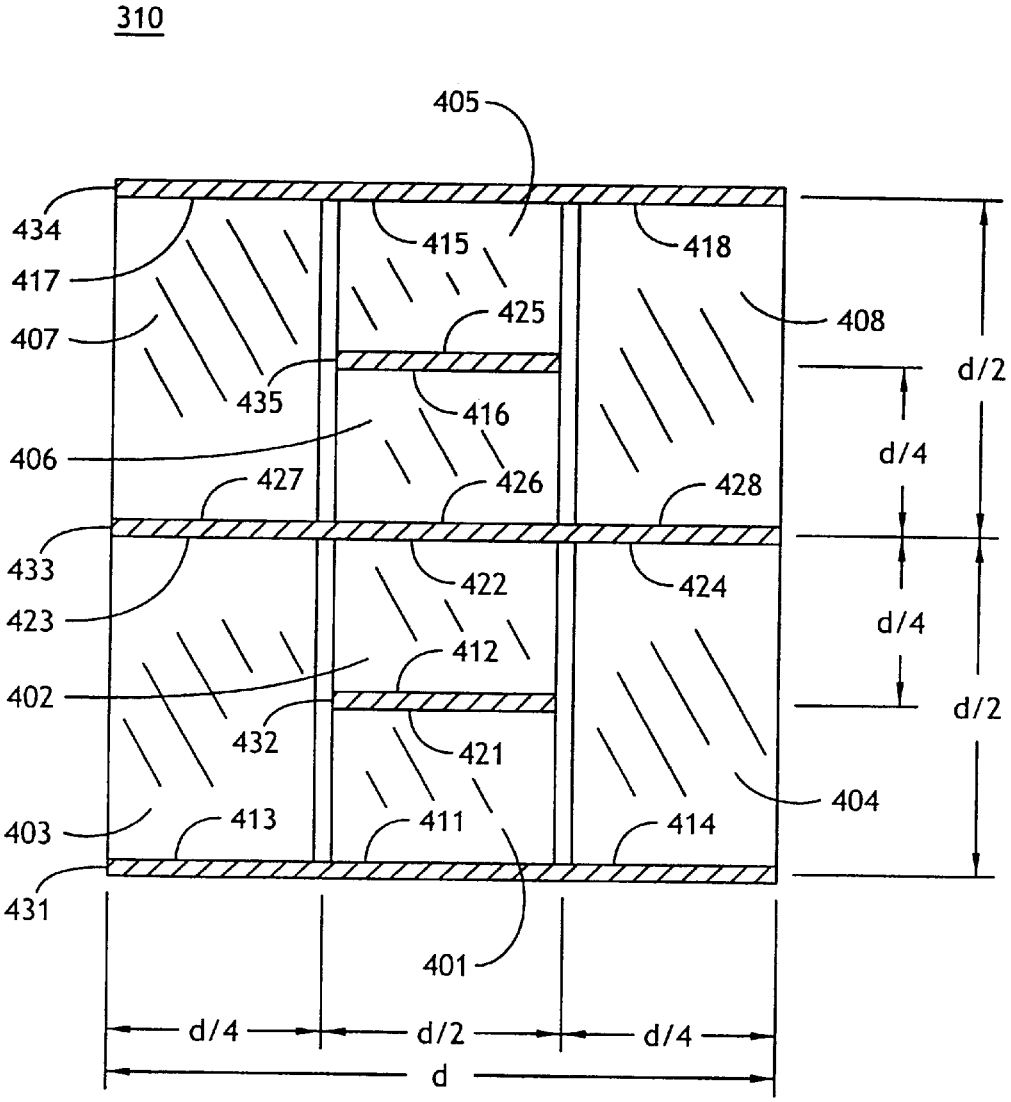
FIG. 4 is a top plan view of a segmented heater resistor in accordance with a preferred embodiment of the present invention.

FIG. 4 is a top plan view of a segmented heater resistor 310 in accordance with a preferred embodiment of the present invention. Orifice plate 206 and barrier layer 314 have been deleted for clarity here. In the preferred embodiment, segmented heater resistor 310 is realized as a thin film planar structure having a square geometric figure pattern approximately 28–32 micrometers on a side ('d' in FIG. 4). The resistance of heater resistor 310 is approximately 35 Ohms per square. Other geometric figures, e.g. trapezoids, split resistors (parallel or series connected), and other useful geometric figures may also be used without departing from the spirit and scope of the present invention. Segmented heater resistor 310 preferably includes multiple heater resistor segments 401–408, and multiple electrical conductors 431–435. As shown in FIG. 4, preferably the dimensions of each of heater resistor segments 403, 404, 407, and 408 are 'd/4'×'d/2' (width×length) and the dimensions of each of heater resistor segments 401, 402, 405, and 406 are 'd/2'×'d/4'. Each heater resistor segment 401–408 includes an input port (i.e., input ports 411–418, respectively) and an output port (i.e., output ports 421–428, respectively). Each input port 411–418 and output port 421–428 is an electrical node that provides an electrical contact with an electrical conductor of the multiple electrical conductors 431–435. Each of the multiple electrical conductors 431–435 is realized as a thin film metallic conductor that is electrically and physically coupled to the heater resistor segments 401–408 as indicated below. Alternate fabrication techniques would include resistor segments formed using vapor deposition, sputtering, or other techniques known to those skilled in the art.

In the preferred embodiment, the multiple heater resistor segments 401–408 and multiple electrical conductors 431–435 are coupled as follows. A first electrical conductor 431 of the multiple electrical conductors is coupled to an input port 411 of a first heater resistor segment 401, an input port 413 of a third heater resistor segment 403, and an input port 414 of a fourth heater resistor segment 404 of the multiple heater resistor segments. A second electrical conductor 432 of the multiple electrical conductors is coupled to an output port 421 of the first heater resistor segment 401 and to an input port 412 of a second heater resistor segment 402. A third electrical conductor 433 of the multiple electrical conductors is coupled to an output port 422 of the second heater resistor segment 402, an output port 423 of the third heater resistor segment 403, and an output port 424 of the fourth heater resistor segment 404, with the result that first and second heater resistor segments 401 and 402 are serially coupled to each other and together are coupled in parallel with each of third and fourth heater resistor segments 403 and 404.

Third electrical conductor 433 is further coupled to an output port 426 of a sixth heater resistor segment 406, an output port 427 of a seventh heater resistor segment 407, and an output port 428 of an eighth heater resistor segment 408 of multiple heater resistor segments 401–408. A fourth electrical conductor 434 of the multiple electrical conductors is coupled to an input port 415 of a fifth heater resistor segment 405 of the multiple heater resistor segments, and is further coupled to an input port 417 of the seventh heater resistor segment 407 and an input port 418 of the eighth heater resistor segment 408. A fifth electrical conductor 435 of the multiple electrical conductors is coupled to an output port 425 of the fifth heater resistor segment 405 and to an input port 416 of the sixth heater resistor segment 406, with the result that fifth and sixth heater resistor segments 405 and 406 are serially coupled to each other and together are coupled in parallel with each of seventh and eighth heater resistor segments 407 and 408.

The segmented heater resistor 310 includes multiple heater resistor segments 401–408 each of which is coupled to one or more nodes or ports, e.g., input ports 421–428 and output ports 431–438 respectively. Voltage is applied to these ports via electrical conductors 431–435. By selectively applying a voltage to predetermined electrical conductors 431–435, as described below, a current flow is induced in selected heater resistor segments of segmented heater resistor 310. Inasmuch as current flow effects a temperature increase in the heater resistor segment, at least a portion of which heat is transferred to the ink in ink firing chamber 306, varying amounts of heat can be transferred to the ink by varying the segments that are energized and hence heated. The dynamic selection of the conductors 431–435 provides for the dynamic variation of an expelled ink drop volume as printer 100 is printing, which is highly desirable to obtain higher print quality.

Figure 5:
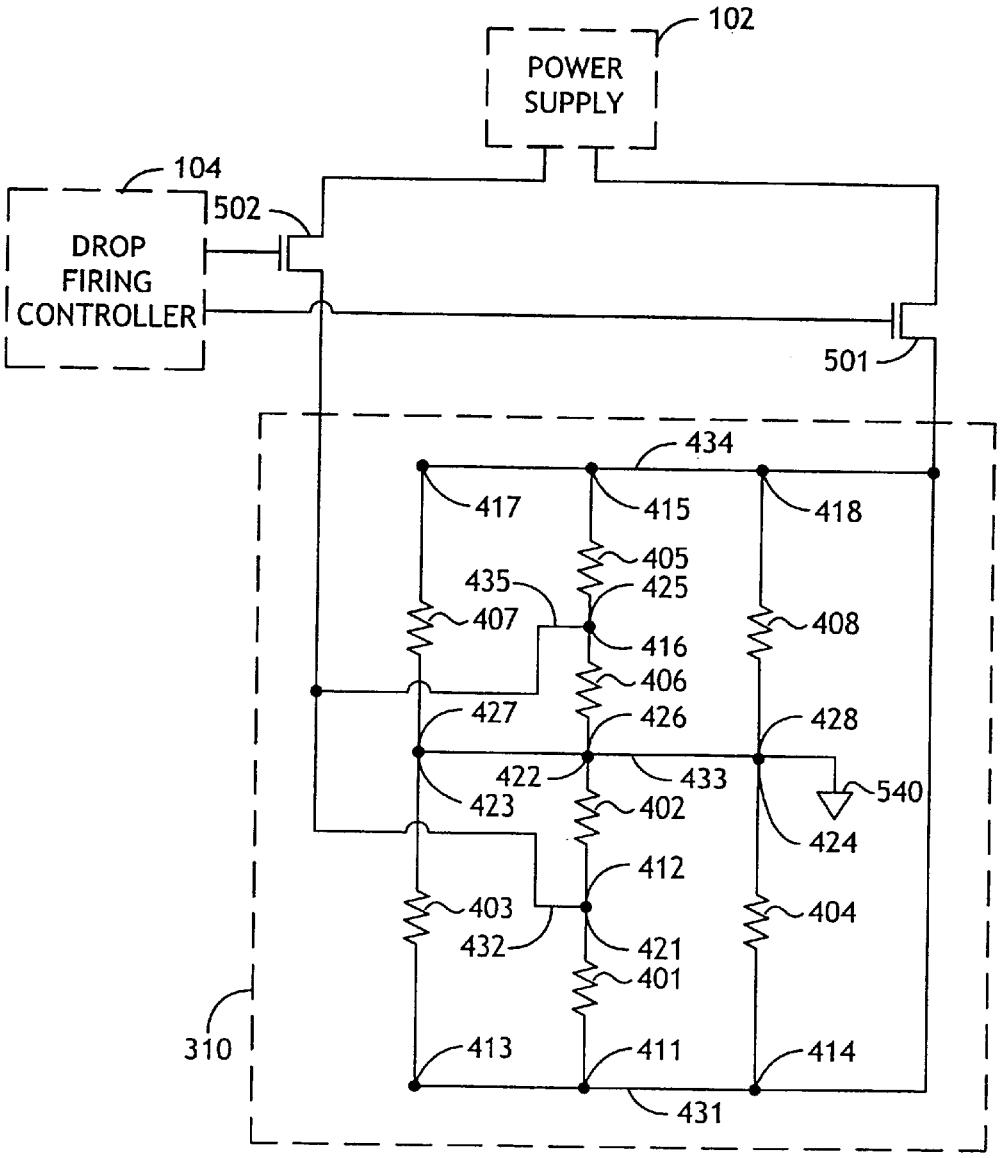
FIG. 5 is an electrical schematic diagram of the segmented heater resistor of FIG. 4 and associated switching devices in accordance with a preferred embodiment of the present invention.

In order to selectively apply a voltage to one or more of multiple electrical conductors 431–435, the invention provides multiple switching devices 501, 502 that are each coupled to power supply 102 and to one or more of multiple electrical conductors 431–435. FIG. 5 is an electrical schematic diagram of segmented heater resistor 310 and associated switching devices 501, 502 in accordance with a preferred embodiment of the present invention. As shown in FIG. 5, first and fourth electrical conductors 431, 434 are each coupled to a first switching device 501, and second and fifth electrical conductors 432, 435 are each coupled to a second switching device 502. Preferably third electrical conductor 433 is coupled to a circuit ground 540. Preferably each switching device 501, 502 includes a MOSFET, which MOSFET is preferably coupled at a gate to drop firing controller 104, at a drain to power supply 102, and at a source to one or more of multiple electrical conductors 431, 432, 434, and 435. Preferably switching devices 501, 502 are included in the circuitry of inkjet cartridge 122; however, in the alternative, the switching devices could be included in layered semiconductor substrate 312, or in the circuitry of carriage 118, or external to carriage 118 and in other circuitry of inkjet printer 100. Those who are of ordinary skill in the art will realize that there are many devices that can perform the switching functions of switching devices 501, 502, such as bipolar junction transistors or other field effect devices, without departing from the spirit and scope of the present invention.

Each switching device 501, 502 is activated in response to the receipt of a control signal, preferably a gate voltage that is equal to or greater than the turn on voltage for the switching device, from drop firing controller 104. In brief and as described in greater detail below, when each switching device 501, 502 is activated, a voltage is sourced by power supply 102, via the switching device, to each electrical conductor of the multiple electrical conductors 431–435 that is coupled to the switching device. The application of a voltage to a conductor 431–435 in turn induces an electric current flow and the dissipation of thermal energy in each heater resistor segment 401–408 that is coupled to the conductor by the segment's respective input port 411–418. With respect to heater resistor segments 401 and 405, when a current flows from a respective input port 411, 415, through the heater resistor segment to a respective output port 421, 425, the current will further flow through the adjacent heater resistor segment 402, 406, respectively, to conductor 433. At least a portion of the energy dissipated in each segment 401–408 is transferred to the ink stored in ink firing chamber 306 to produce a drive bubble and the expulsion of ink from chamber 306. The selective activation of a switching device 501, 502 results in the selective application of a voltage to, and induction of an electrical current flow in, heater resistor segments 401–408 and, ultimately, a controlled variation in the volume of ink expelled from chamber 306.

In the preferred embodiment, when first switching device 501 is activated by drop firing controller 104, a first voltage, preferably approximately 8 volts (V), is sourced by power supply 102 to each of electrical conductor 431 and electrical conductor 434. Those of ordinary skill in the art will realize that voltage levels other than 8V may be applied here without departing from the spirit and scope of the present invention. The application of the first voltage to electrical conductor 431 creates a potential energy drop across heater resistor segments 401–404. The potential energy drop across heater resistor segments 401–404 results in a first electrical current flow from conductor 431, through heater resistor segments 401–404, to conductor 433. The flow of electrical current across heater resistor segments 401–404 results in the dissipation of energy in heater resistor segments 401–404 in the form of heat, at least a portion of which heat is transferred to ink stored in the ink firing chamber 306.

Similarly, the application of the first voltage to electrical conductor 434 creates a potential energy drop across heater resistor segments 405–408. The potential energy drop across heater resistor segments 405–408 results in a second electrical current flow from conductor 434, through heater resistor segments 405–408, to conductor 433. The flow of electrical current across heater resistor segments 405–408 results in the dissipation of energy in heater resistor segments 405–408 in the form of heat, at least a portion of which heat is transferred to the ink stored in ink firing chamber 306. The heat transferred from heater resistor segments 401–404 and 405–408 to the ink in ink firing chamber 306 results in the nucleation of a drive bubble that expands and forces an ink drop from chamber 406.

When second switching device 502 is activated by drop firing controller 104, a second voltage, preferably approximately 7V, is sourced by power supply 102 to each of electrical conductor 432 and electrical conductor 435. Again, those of ordinary skill in the art will realize that voltage levels other than 7V may be applied here without departing from the spirit and scope of the present invention. The application of the second voltage to electrical conductor 432 creates a potential energy drop across heater resistor segment 402. Similarly, the application of the second voltage to electrical conductor 435 creates a potential energy drop across heater resistor segment 406. The potential energy drop across heater resistor segment 402 results in a first electrical current flow from conductor 432, through heater resistor segment 402, to conductor 433. Similarly, the potential energy drop across heater resistor segment 406 results in a second electrical current flow from conductor 435, through heater resistor segment 406, to conductor 433. When second switching device 502 is activated, additional current may flow through the other heater resistor segments that are a part of segmented heater resistor 310 (i.e., heater resistor segments 401, 403–405, and 407–408). However, the current flowing through each of the other heater resistor segments will be nominal as compared to the current flowing through each of heater resistor segments 402 and 406 due to the higher resistance presented to current flow through paths that include heater resistor segments 401 and 403, 401 and 404, 405 and 407, and 405 and 408.

Current flow through heater resistor segments 402 and 406 results in the dissipation of energy in heater resistor segments 402 and 406 in the form of heat, at least a portion of which heat is transferred to the ink stored in ink firing chamber 306. Heat transferred from one or more of heater resistor segments 402 and 406 to ink in ink firing chamber 306 results in the nucleation of a drive bubble that expands and forces an ink drop from chamber 306. Since heater resistor segments 401–408 cover a larger surface area than heater resistor segments 402 and 406, the drive bubble produced by the activation of switching device 501 is larger than the drive bubble produced by the activation of switching device 502, which larger drive bubble results in the expulsion from ink firing chamber 306 of a larger ink drop. By dynamically selecting the activation of either switching device 501 or switching device 502, the size of the ink drop expelled by chamber 306 may be dynamically adjusted, allowing for an additional level of control of variations of hue and lightness in characters or print images on print media 124 without the need to vary the amplitude of the applied voltage or any electrical pulse widths or to vary the thickness of the protective layer.

The present invention provides for the dynamic selection of a variable ink drop volume for expulsion from ink drop generator 300 by dynamically selecting the amount of heat input to the ink to be expelled. A segmented heater resistor 310 in the ink drop generator includes multiple heater resistor segments 401–408 and multiple electrical conductors 431–435. The segmented heater resistor 310 is coupled to multiple switching devices 501, 502, and by selectively activating each of switching devices 501 and 502 a voltage may be selectively applied to the heater resistor segments 431–435. The application of the voltage to a heater resistor segment 431–435 produces a current flow in the segment that results in the dissipation of energy in the segment and a concomitant temperature rise in the segment. At least a portion of the heat so generated in each segment 431–435 is transferred to ink in an ink firing chamber 306, producing a drive bubble that expels an ink drop from chamber 306. By selectively activating switching devices 501 and 502 and varying the number of segments 401–405 to which the voltage is applied, the amount of energy transferred to the ink may be varied along with the resulting drive bubble size and the volume of the ink drop expelled. The present invention thereby affords printer 100 improved control over a quantity of ink transferred to print media 124 and thereby improved control of image lightness, contrasts and hues, resulting in better image quality.

Figure 6:
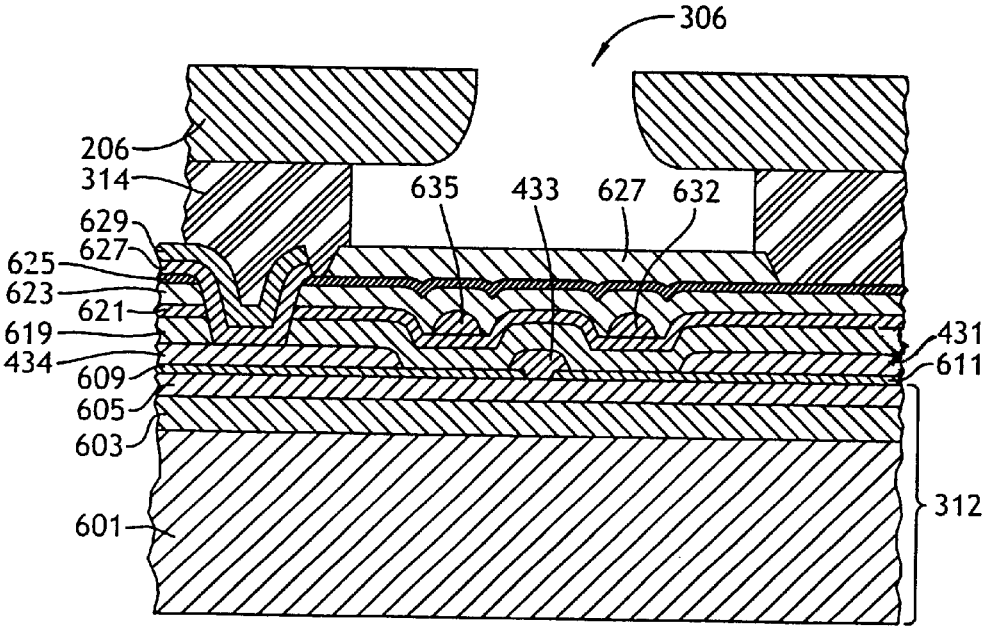
FIG. 6 is a cross-sectional elevation illustration of the ink drop generator of FIG. 3 in accordance with a preferred embodiment of the present invention.

FIG. 6 is a cross-section illustration of ink firing chamber 306 in accordance with a preferred embodiment of the present invention. Substrate 312 includes a semiconductor base 601 of silicon, treated using either thermal oxidation of vapor deposition techniques to form a thin layer 603 of silicon dioxide and a thin layer 605 of phospho-silicate glass (PSG) thereon. The silicon dioxide and PSG form an electrically insulating layer approximately 17000 Angstroms thick upon which a subsequent layer of tantalum-aluminum (TaAl) resistive material is deposited.

The TaAl layer is deposited to a thickness of approximately 900 Angstroms to yield a resistivity of approximately 35 Ohms per square. In the preferred embodiment, the resistive layer is conventionally deposited using a magnetron sputtering technique and then masked and etched to create discontinuous and electrically independent areas of resistive material such as areas 609 and 611. A first metal layer of aluminum-copper-silicon (AlSiCu) alloy conductor is conventionally magnetron sputter deposited to a thickness of approximately 5000 Angstroms atop the TaAl layers and etched to provide discontinuous independent electrical conductors (e.g., conductors 431, 433, and 434) and interconnect areas. To provide protection for the heater resistors and the connecting conductors, a first composite layer of passivating materials is deposited over the upper surface of the first metal layer. Preferably, the composite layer includes a first layer 619 of silicon nitride approximately 2500 Angstroms thick and a second layer 621 of inert silicon carbide approximately 1200 Angsroms thick. The composite layer is etched to provide interconnect areas for the first metal and a second metal layer. The second metal layer of AlSiCu alloy conductor is then conventionally magnetron sputter deposited to a thickness of approximately 5000 Angstroms and etched to provide electrical conductors 632, 635 that provide for electrical contacts between conductors 432 and 435 and devices outside of segmented heater resistor 310. Then a second composite layer 623, 625 of passivating materials is deposited over the upper surface of the second metal layer. An area over segmented heater resistor 310 and its associated electrical connections is masked and a cavitation layer 627 of tantalum approximately 3000 Angstroms thick is conventionally deposited. A gold layer 629 may be selectively added to the cavitation layer 627 in layers where electrical connection to an interconnection material is desired. Examples of semiconductor processing for thermal inkjet applications may be found in U.S. Pat. No. 4,862,197, "Process for Manufacturing Thermal Inkjet Printhead and Integrated Circuit (IC) Structures Produced Thereby," and in U.S. Pat. No. 5,883,650, "Thin-Film Printhead Device for an Inkjet Printer."

Preferably, barrier layer 314 consists of a polymer that is conventionally deposited upon substrate 312 and its various protective layers and is then photolithographically defined into desired shapes and then etched. Orifice plate 206 is secured to substrate 312 by barrier layer 314, or alternately is integrally formed on the substrate with the barrier layer, and preferably is constructed of nickel plated with gold, or alternately of a polymide material.

In sum, the present invention provides improved image quality for an inkjet printer without the need to vary the pulse widths applied to a heater resistor or the need to finely control the tolerances of the semiconductor processing techniques. The dynamic activation of select switching devices in turn results in the dynamic selection of heater resistor segments to which a voltage is applied, ultimately providing for the expulsion of a variable volume ink drop from an ink drop generator. The provision of a variable volume ink drop allows for finer control by the inkjet printer of gradations of lightness, contrast, and hue in printer images and improved overall image quality.

While the present invention has been particularly shown and described with reference to particular embodiments thereof, it will be understood by those skilled in the art that various changes in form and details may be made therein without departing from the spirit and scope of the present invention.

What is claimed is:

1. An inkjet drop generator comprising:

a first resistor segment with an input and an output;

a second resistor segment with an input and an output, disposed adjacent the first resistor segment;

a first conductor, coupled to the first resistor segment input, for accepting an applied first voltage;

a second conductor, coupled to the first resistor segment output and to the second resistor segment input, for accepting an applied second voltage;

a third conductor coupled to the second resistor segment output;

wherein a first current flows in the first resistor segment and the second resistor segment when the first voltage is applied, wherein a second current flows in the first resistor segment and a third current flows in the second resistor segment when the second voltage is applied, and wherein the first current is greater than the second current.

2. The inkjet drop generator of claim 1, further comprising a circuit ground that is coupled to the third conductor.

3. An inkjet drop generator comprising:

a first segmented heater resistor segment comprising an input port and an output port;

a second segmented heater resistor segment disposed adjacent to the first heater resistor segment and comprising an input port and an output port;

a first electrical conductor, coupled to the input port of the first heater resistor segment, for receiving a first voltage;

a second electrical conductor, coupled to the output port of the first heater resistor segment and to the input port of the second heater resistor segment, for receiving a second voltage;

a third electrical conductor coupled to the output port of the second heater resistor segment;

wherein a first electrical current flows in the first segmented heater resistor segment and the second heater resistor segment when the first voltage is applied to the first electrical conductor, wherein a second electrical current flows in the first segmented heater resistor segment and a third electrical current flows in the second segmented heater resistor segment when the second voltage is applied to the second electrical conductor, and wherein the first electrical current is greater than the second electrical current.

4. The inkjet drop generator of claim 3, further comprising a circuit ground that is coupled to the third electrical conductor.

5. An inkjet drop generator for an inkjet printer print cartridge, comprising:

an orifice plate comprising a top side and a bottom side and further comprising at least one aperture, wherein the top side provides an external surface for the ink drop generator;

a substrate disposed below the bottom side of the orifice plate, the substrate comprising a segmented heater resistor, wherein the substrate comprises:

a plurality of segmented heater resistor segments comprising a first segment of the plurality of segmented heater resistor segments and a second segment of the plurality of segmented heater resistor segments, wherein each segmented heater resistor segment of the plurality of segmented heater resistor segments comprises an input port and an output port;

a plurality of electrical conductors comprising a first electrical conductor of the plurality of electrical conductors, a second electrical conductor of the plurality of electrical conductors, and a third electrical conductor of the plurality of electrical conductors, wherein each input port and each output port of each segmented heater resistor segment of the plurality of segmented heater resistor segments is coupled to an electrical conductor of the plurality of electrical conductors; and wherein an application of a voltage to the first electrical conductor produces a first electrical current flow in the first segmented heater resistor segment and the second segmented heater resistor segment, wherein an application of a voltage to the second electrical conductor produces a second electrical current flow in the first segmented heater resistor segment and a third electrical current flow in the second segmented heater resistor segment, and wherein the first electrical current flow is greater than the second electrical current flow.

6. The inkjet drop generator of claim 5, further comprising a barrier layer disposed between the orifice plate and the substrate.

7. The inkjet drop generator of claim 5, further comprising a plurality of switching devices, wherein the plurality of switching devices comprises a first switching device and a second switching device, wherein the first switching device is coupled to the first electrical conductor, and wherein the second switching device is coupled to the second electrical conductor.

8. The inkjet drop generator of claim 7, wherein each switching device of the plurality of switching devices is included in the substrate.

9. A print cartridge for an inkjet printer comprising:

an inkjet drop generator comprising a segmented heater resistor, wherein the segmented heater resistor comprises:

a plurality of segmented heater resistor segments, wherein each segmented heater resistor segment includes an input port and an output port;

a plurality of electrical conductors, wherein each input port and each output port of each segmented heater resistor segment is coupled to an electrical conductor of the plurality of electrical conductors;

a first switching device coupled to the segmented heater resistor that is coupled to a first voltage when closed;

a second switching device coupled to the segmented heater resistor that is coupled to a second voltage when closed; and wherein when the first voltage is applied by the first switching device to the segmented heater resistor, a first electrical current flow is produced across at least two segmented heater resistor segments of the plurality of segmented heater resistor segments, wherein when the second voltage is applied by the second switching device to the segmented heater resistor, a second electrical current flow is produced across at least one segmented heater resistor segment of the plurality of segmented heater resistor segments and a third electrical current flow is produced across a different segmented heater resistor segment of the plurality of segmented heater resistor segments, and wherein the first electrical current flow is greater than the third electrical current flow.

10. The print cartridge of claim 9, further comprising an ink reservoir coupled to the ink drop generator that sources ink to the ink drop generator, wherein an ink drop of a first volume is produced by the ink drop generator in response to the applying of the first voltage by the first switching device to the first electrical conductor, wherein an ink drop of a second volume is produced by the ink drop generator in response to the applying of the second voltage by the second switching device to the second electrical conductor, and wherein the first volume is greater than the second volume.

11. An inkjet printer comprising:

a power supply that produces a voltage;

a controller;

a first switching device coupled to the power supply and to the controller;

a second switching device coupled to the power supply and to the controller; and a print cartridge coupled to the first switching device, to the second switching device, and to the controller, wherein the print cartridge comprises an inkjet drop generator, wherein the inkjet drop generator comprises a segmented heater resistor, and wherein the segmented heater resistor comprises:

a plurality of segmented heater resistor segments, wherein each segmented heater resistor segment includes an input port and an output port;

a plurality of electrical conductors, wherein each input port and each output port of each segmented heater resistor segment is coupled to an electrical conductor of the plurality of electrical conductors; and wherein when a first voltage is applied by the first switching device to the segmented heater resistor, a first electrical current flow is produced across at least two segmented heater resistor segments of the plurality of segmented heater resistor segments, wherein when a second voltage is applied by the second switching device to the segmented heater resistor, a second electrical current flow is produced across at least one segmented heater resistor segment of the plurality of segmented heater resistor segments and a third electrical current flow is produced across a different segmented heater resistor segment of the plurality of segmented heater resistor segments, and wherein the first electrical current flow is greater than the third electrical current flow.

12. The inkjet printer of claim 11, wherein the first switching device and the second switching device are each included in the print cartridge.

13. The inkjet printer of claim 11, wherein the ink reservoir is included in the print cartridge.

14. The inkjet printer of claim 11, wherein when the first switching device is activated and the second switch device is inactivated an ink drop of a first volume is produced by the ink drop generator, and wherein when the first switching device is inactivated and the second switching device is activated an ink drop of a second volume is produced by the ink drop generator, and wherein the first volume is greater than the second volume.

* * * * *